US006390339B1

(12) United States Patent
Lee

(10) Patent No.: US 6,390,339 B1
(45) Date of Patent: May 21, 2002

(54) FALL-OFF PREVENTION ELEMENT OF A LIQUID CONTAINER CAP

(75) Inventor: Yu-Kang Lee, Taipei (TW)

(73) Assignee: Jung Kuo Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/922,156

(22) Filed: Aug. 6, 2001

(51) Int. Cl.[7] ..... B65D 88/54
(52) U.S. Cl. ..... 222/321.9; 222/385; 222/402.1
(58) Field of Search ..... 222/321.9, 385, 222/402.1

(56) References Cited

U.S. PATENT DOCUMENTS 5,439,148 A * 8/1995 Driessen ..... 222/402.1
5,570,819 A * 11/1996 Uehira et al. ..... 222/321.9
6,227,416 B1 * 5/2001 Lee ..... 222/321.9

* cited by examiner

*Primary Examiner*—Philippe Derakshani
(74) *Attorney, Agent, or Firm*—Rosenberg, Klein & Lee

(57) ABSTRACT

A liquid container has a content ejecting device fitted to the holding body, and a fall-prevention element provided on the content ejecting device, which has a cap depressable for the content to be ejected. The ejecting device includes a connecting member, the cap and a straw combination. The connecting member has an annular protrusion on a tube stub sticking up from the main surface, and is secured to the holding body. The cap is movably mounted onto the tube stub, and has annular protrusions on the inner side. The straw combination communicates with the cap and is received in the holding body from the lower portion as to eject the content via the cap when the cap is depressed. The annular protrusion of the tube stub will come into contact with the annular protrusions of the cap to prevent the holding body from falling down when the container is lifted from the cap.

2 Claims, 3 Drawing Sheets

FALL-OFF PREVENTION ELEMENT OF A LIQUID CONTAINER CAP

BACKGROUND OF THE INVENTION

The present invention relates to a fall-off prevention element of a liquid container cap, and more particularly to a fall-off prevention element of a liquid container cap which is an integral part of a content ejecting member of the container and can be depressed for the contents of the container to be ejected.

Containers are often used for holding liquid detergents, shampoo, hair spray, etc that are provided with content ejecting devices having caps depressable to eject the contents of the containers.

Referring to FIG. 4, a heretofore known content ejecting device of a container includes a connecting member 10, a straw combination 30 and a cap 40. The connecting member 10 is secured to the top of a container 20. The straw combination 30 includes a main body in the middle part, a straw 301 connected to the lower end of the main body and received in the container 20, and a connecting tube 302 connected to the upper end of the main body and passed into the cap. The main body of the straw combination 30 is devised in such a manner as to force the contents of the container 20 to move out of the cap 40 via the straw 301 and the same when the cap 40 is depressed. However, we are not going to detail the structure of the main body of the straw combination or show the same in the drawings because it is not the subject of the present invention.

The content ejecting device has a drawback that the cap will separate from the connecting tube very easily when the user lifts the container by the cap to take the container from one place to another. Consequently, the container will fall down to the ground to cause the user inconvenience and even get deformed or broken.

SUMMARY OF THE INVENTION

Therefore, it is a main object of the present invention to provide a fall-off prevention element to a liquid container cap so that the cap won't separate from the container to cause the container to fall down to the ground when a user lift the container by the cap.

The container takes the form that includes a content ejecting device fitted to the main holding part thereto. The content ejecting device includes a connecting member, a cap and a straw combination; the connecting member is secured to the holding part of the container, and has an annular protrusion formed on the outer side of a tube stub sticking up from the main surface; the cap is movably mounted onto the tube, and has annular protrusions, which are formed on the inner side and arranged below the annular protrusion of the tube stub.

The straw combination communicates with the cap from an upper end, and is received in the holding part of the container from a lower part so as to be able to eject the contents of the container via the same and the cap when the cap is depressed. The annular protrusion of the tube stub will come into contact with the uppermost one of the annular protrusions of the cap to prevent the cap from failing off the connecting member when the container is lifted from the cap. Thus, the user can lift the container by the cap to take it from one place to another without risk of the holding part falling down.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
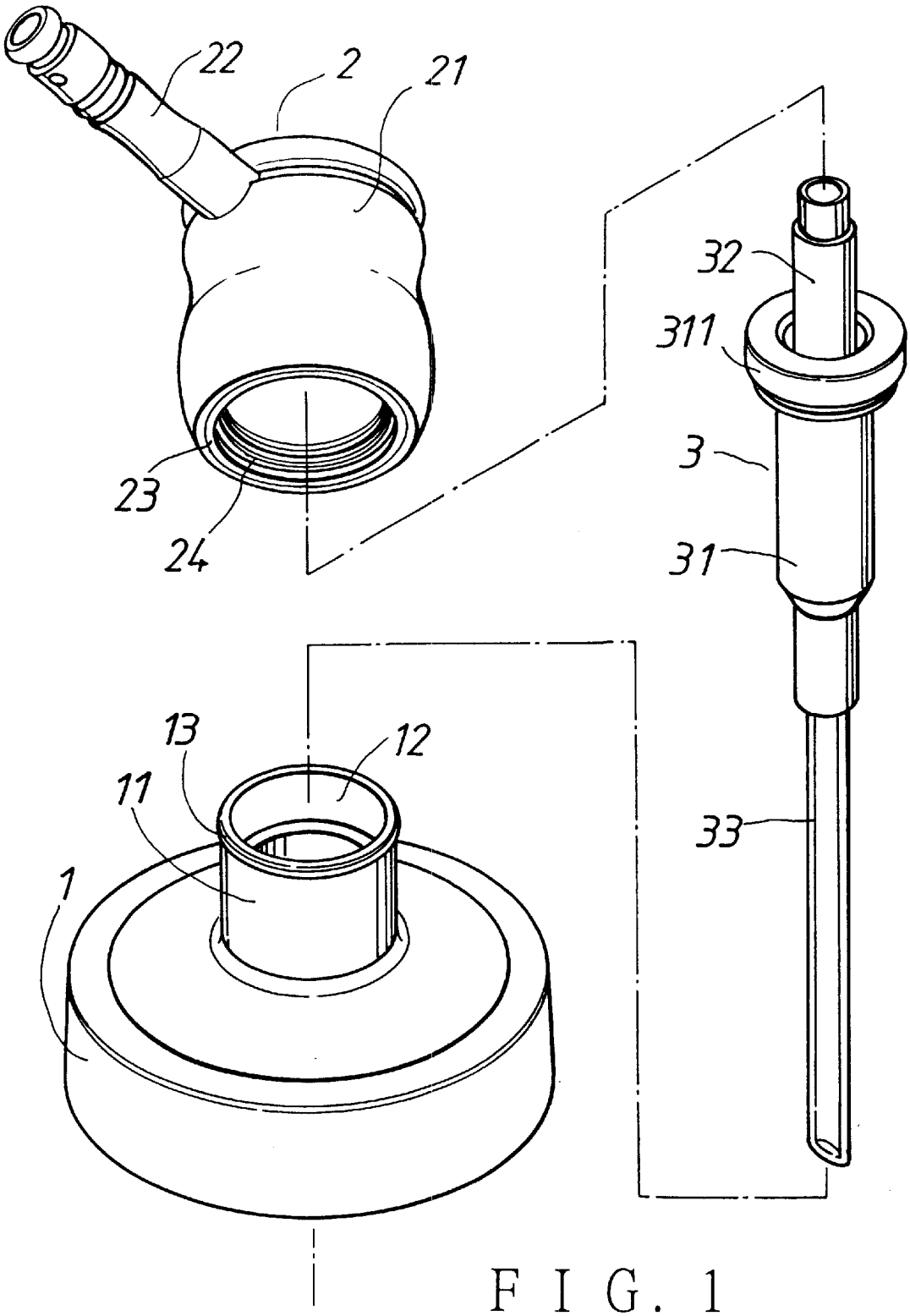
FIG. 1 is an exploded perspective view of the content ejecting device of a container according to the present invention.
Figure 2:
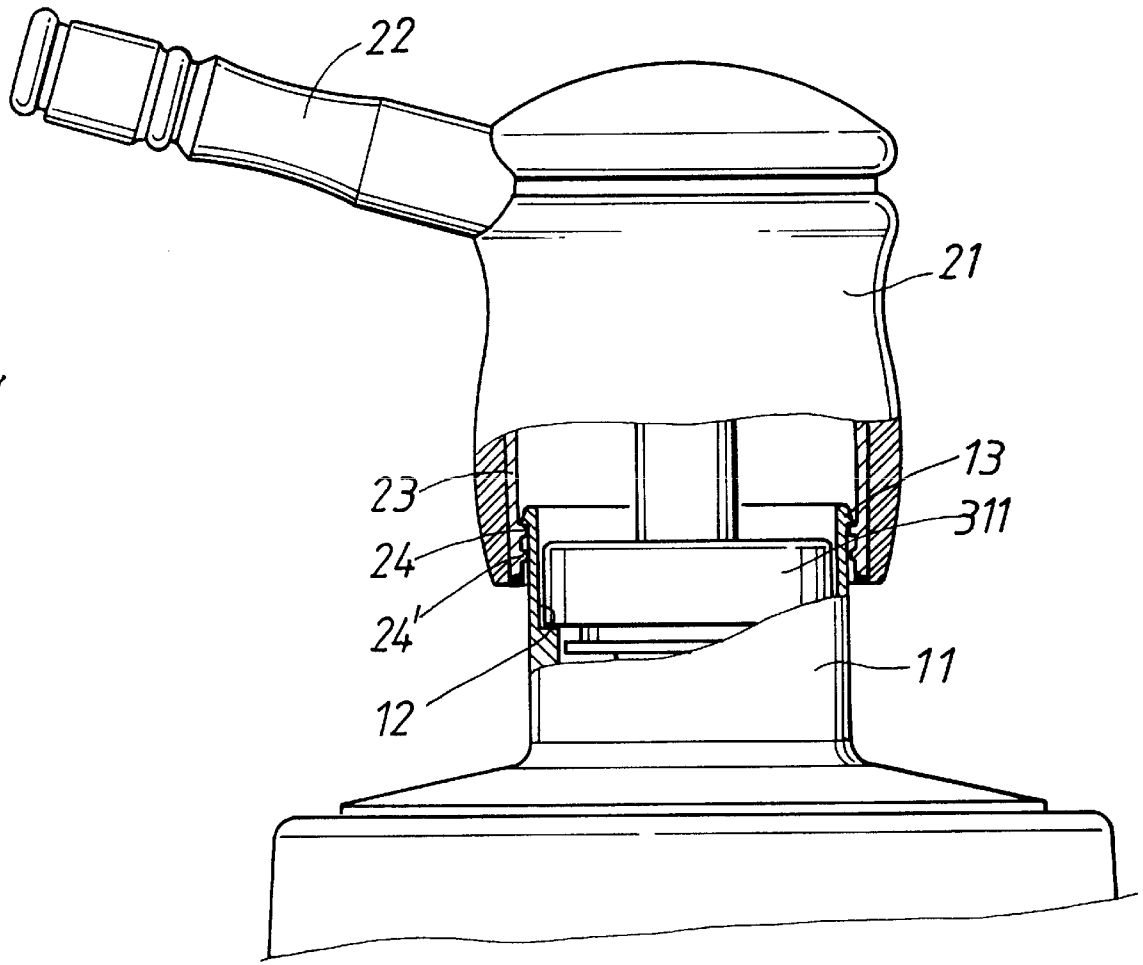
FIG. 2 is a cross-sectional view of the container cap with the fall-off prevention element according to the present invention.
Figure 3:
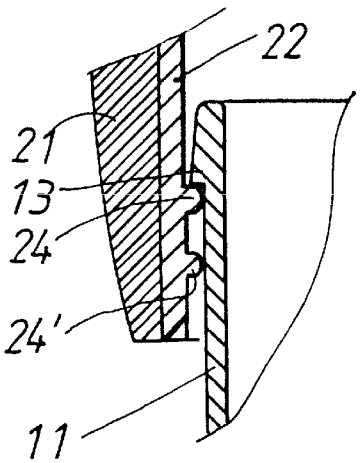
FIG. 3 is a fragmentary cross-sectional view of the fall-off prevention element in FIG. 2.
Figure 4:
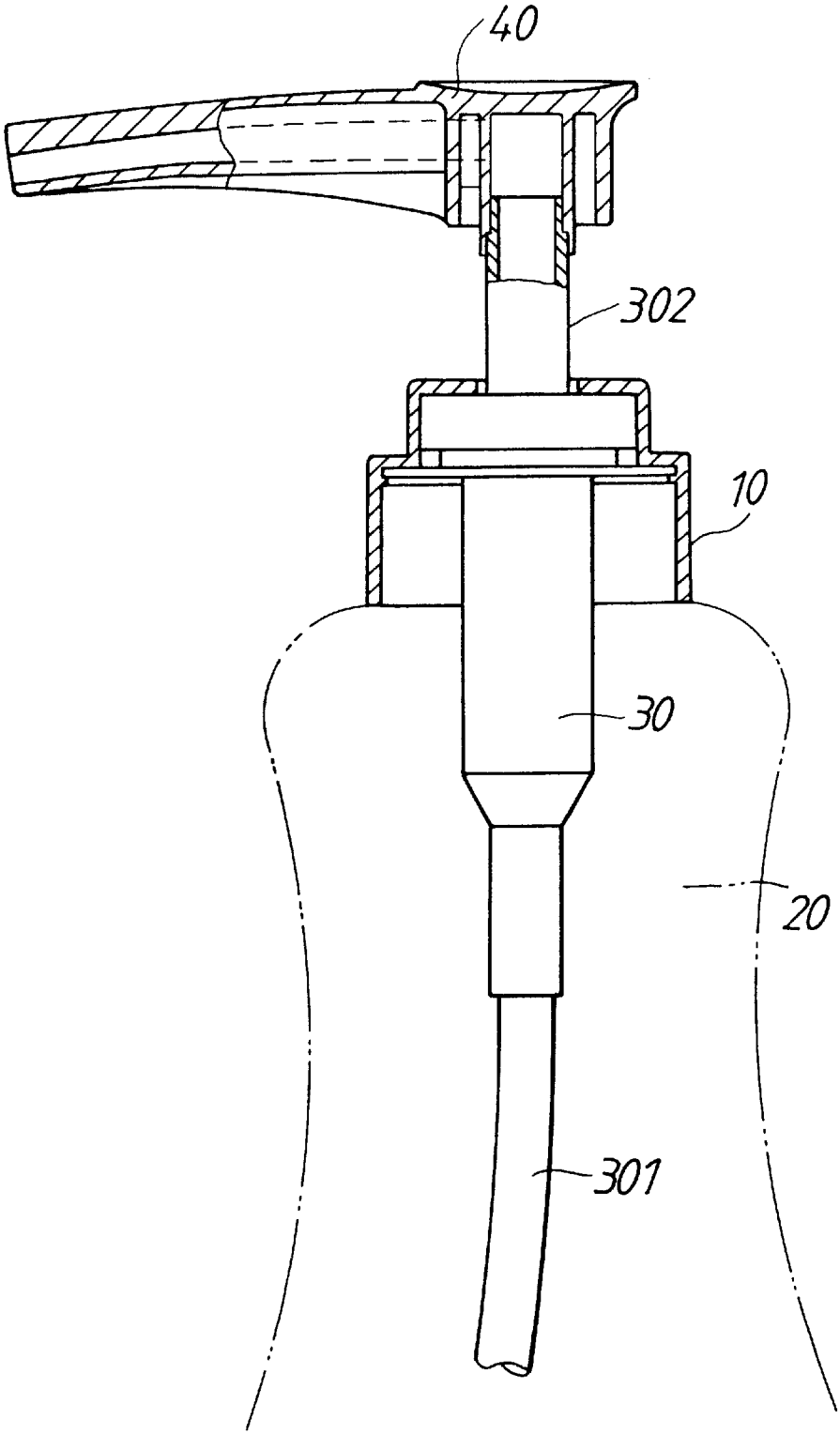
F I G. 4 (PRIOR ART)
FIG. 4 is a side plan view of the prior art content ejecting device of a container in the Background.

Referring to FIGS. 1 and 2, the content ejecting device of a liquid container of the present invention includes a connecting member 1, a cap 2 and a straw combination 3.

The connecting member 1 is securely connected to the top of the container, and has a tube stub 11 sticking up from the main surface. The tube stub 11 is formed with a holding room 12 defined by an annular depressed portion on an upper part of the inner side thereon and an annular protrusion 13 on the upper end of the outer side thereof The cap 2 includes a depressed part 21, and a nozzle 22 communicating with the depressed part 21. An interior bushing 23 is tightly fitted into the depressed part 21, and formed with several annular protrusions 24 on the inner side. The interior bushing 23 further has a positioning element (not shown) in the upper part thereof.

The straw combination 3 includes a main body 31, a connecting tube 32, a straw element 33 and a positioning ring 311 formed on the upper part of the outer side of the main body 31. The main body 31 is provided with springs, steel balls (not shown) and so on in it, and is devised in such a manner as to force the liquid contents of the container to move upwards via the straw combination 3 and the cap 2 to outside for use when the cap 2 is depressed in a combination with the connecting member 1, the straw combination 3 and the container that will be detailed in the following.

In combination, the upper part of the tube stub 11 is received in the interior bushing 23 of the cap 2 with the uppermost one of the annular protrusions 24 of the interior bushing 23 being arranged below the annular protrusion 13 of the tube stub 11. The positioning ring 311 of the straw combination 3 is received in the holding room 12 of the connecting member 1, and held by that part of the inner side of the tube stub 11 below annular depressed portion. The connecting tube 32 is connected to the positioning element of the bushing 23 to communicate with the nozzle 22. The main body 31 and the straw element 33 are received in the container. So, the liquid contents of the container can be ejected via the straw combination 3 and the nozzle 22 when the cap 2 is depressed and released repeatedly to move the connecting tube 32 up and down.

Furthermore, the annular protrusion 13 on the tube stub 11 of the connecting member 1 secured to the container will come into contact with the uppermost annular protrusion 24 of the bushing 23 to prevent the cap 2 from falling off the connecting member 1 when a user lifts the container by the cap 2, thus avoiding the falling down of the container that will cause the user inconvenience, and might cause damage to the container. In addition, when the cap 2 is depressed and released repeatedly to eject the liquid content, the annular protrusions 24' of the bushing 23 are relatively close to the outer side of the tube stub 11 to be helpful in keeping the cap 2 in an upright position when the cap 2 is moving up and down.

From the above description, it can be easily understood that the annular protrusion of both of the cap bushing 23 and the connecting member tube stub 11 can help the cap 2 to be mounted on the tube stub 11 in a secured manner, preventing the cap 2 from unwantedly falling off the container to result in the falling down of the container when a user lifts the container by the cap, and that the annular protrusions of the bushing can also help the cap to move up and down in a desirable upright position so that the content ejecting device can be operated smoothly.

What is claimed is:

1. A fall-off prevention element of a liquid container cap, comprising:

a connecting member coupled to a top of a container, said connecting member having a tube stub extending therefrom, said tube stub having an annular protrusion formed thereon;

a cap movably mounted on said tube stub of said connecting member, said cap having an interior bushing securely fitted to an inner side thereof, said bushing having a plurality of annular protrusions formed therein; and, a straw combination having a lower end disposed in the container and an upper end communicating with said cap for dispensing liquid from the container responsive to depression of said cap, said annular protrusion of said tube stub contacting an uppermost one of said plurality of annular protrusions of said bushing for preventing separation of said cap from said connecting member when said container is lifted by said cap.

2. A fall-off prevention element of a liquid container cap, comprising:

a connecting member coupled to a top of a container, said connecting member having a tube stub extending therefrom, said tube stub having an annular protrusion formed adjacent an end thereof;

a cap movably mounted on said tube stub of said connecting member for reciprocal movement thereon, said cap having at least a pair of annular protrusions formed in parallel spaced relationship thereon and in contact with an outer surface of said tube stub; and, a straw combination having a lower end disposed in the container and an upper end communicating with said cap for dispensing liquid from the container responsive to depression of said cap, said annular protrusion of said tube stub contacting an uppermost one of said at least a pair of annular protrusions of said cap for preventing separation of said cap from said connecting member when said container is lifted by said cap.

* * * * *